US011206877B2

(12) United States Patent
Vitarana et al.

(10) Patent No.: US 11,206,877 B2
(45) Date of Patent: Dec. 28, 2021

(54) GARMENT FOR REDUCING HOT FLUSHES OR RELIEVING ASSOCIATED SYMPTOMS

(71) Applicant: MAS INNOVATION (PRIVATE) LIMITED, Colombo (LK)

(72) Inventors: Ranil Vitarana, Colombo (LK); Mapitiyage Don Janith Dushyantha, Colombo (LK)

(73) Assignee: MAS INNOVATION (PRIVATE) LIMITED, Colombo (LK)

( * ) Notice: Subject to any disclaimer, the term of this patent is extended or adjusted under 35 U.S.C. 154(b) by 0 days.

(21) Appl. No.: 17/240,657

(22) Filed: Apr. 26, 2021

(65) Prior Publication Data

US 2021/0251312 A1 Aug. 19, 2021

Related U.S. Application Data

(63) Continuation of application No. 16/470,718, filed as application No. PCT/SG2018/050498 on Oct. 2, 2018.

(30) Foreign Application Priority Data

Oct. 2, 2017 (GB) ..... 1716031

(51) Int. Cl.
*A41D 13/005* (2006.01)
*A41D 31/12* (2019.01)

(52) U.S. Cl.
CPC ..... *A41D 13/0053* (2013.01); *A41D 31/125* (2019.02); *A41D 2500/10* (2013.01)

(58) Field of Classification Search
CPC ..... A41D 13/0053; A41D 13/0056; A41D 31/125; A41D 31/02; A41D 31/14;
(Continued)

(56) References Cited

U.S. PATENT DOCUMENTS 8,440,119 B2 * 5/2013 Ackroyd ..... D04B 9/00 264/78
8,945,287 B2 * 2/2015 Haggquist ..... A41D 31/102 96/4

(Continued)

OTHER PUBLICATIONS

Freedman, Robert R. "Menopausal Hot Flashes: Mechanisms, Endocrinology, Treatment" J Steroid Biochem Mol Biol. Jul. 2014 ; 142:115-120. doi:10 1016/j.jsbmb.2013.08.010. (14 pages).

(Continued)

*Primary Examiner* — Gloria M Hale
(74) *Attorney, Agent, or Firm* — Osha Bergman Watanabe & Burton LLP

(57) ABSTRACT

A wearable device, such as a garment or containing garment portions, for managing and/or reducing the symptoms of a hot flash in a subject. The device comprises: a first set of components, each comprising a fabric comprising a cooling yarn; a second set of components, each comprising a quick-dry wicking fabric; and a third set of components, each comprising a phase change material fabric, wherein the first set of components are adapted to cover at least a neckline region and a peripheral region that extends adjacently around the armpit and the clavicle of the subject; the second set of components are adapted to cover at least the abdominal muscles and the lumbar regions of the subject; and the third set of components are adapted to cover at least the mammary and the dorsum regions of the subject.

19 Claims, 6 Drawing Sheets

(58) Field of Classification Search
CPC .... A41D 31/04; A41D 31/145; A41D 31/102; A41D 31/185; A41D 13/0015; A41D 13/0017; A41D 2600/10; A41D 2600/00; A41D 2500/10
USPC ..... 2/113, 69
See application file for complete search history.

(56) References Cited

U.S. PATENT DOCUMENTS 9,121,642 B2 * 9/2015 Ackroyd ..... D03D 1/00
2007/0193228 A1 * 8/2007 Astier ..... B21C 37/042 53/452
2007/0207689 A1 * 9/2007 Taylor ..... F41H 5/0471 442/135
2008/0233368 A1 * 9/2008 Hartmann ..... D06M 23/12 428/206
2012/0015155 A1 * 1/2012 Blackford ..... A43B 23/0235 428/189
2013/0166074 A1 * 6/2013 Hattori ..... F24F 11/30 700/276
2014/0109285 A1 * 4/2014 Amarasiriwardena .. A41B 1/08 2/69
2015/0013047 A1 * 1/2015 Weiser ..... D01D 5/12 2/243.1

OTHER PUBLICATIONS

Kronenberg, Fredi et al. "Modulation of Menopausal Hot Flashes By Ambient Temperature" J. therm. Biol. vol. 17, No. 1, pp. 43-49, 1992 (7 pages).
Freedman, Robert R. "Pathophysiology and Treatment of Menopausal Hot Flashes" Seminars in Reproductive Medicinevolume 23, No. 2 2005 (9 pages).
Freedman, Robert R. "Physiology of Hot Flashes" American Journal of Human Biology 13:453-464 (2001) (12 pages).

* cited by examiner

FIG. 1(A)
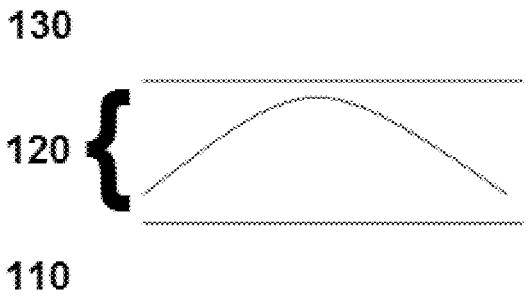
FIG. 1(B)
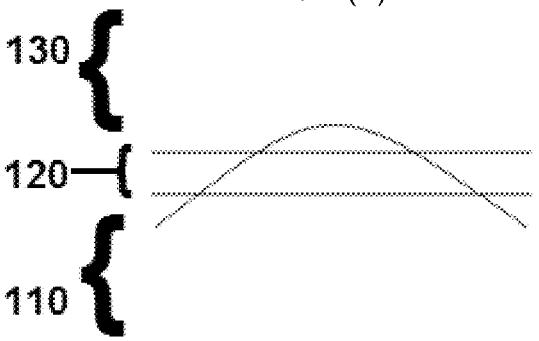
FIG. 2(A)
FIG. 2(B)
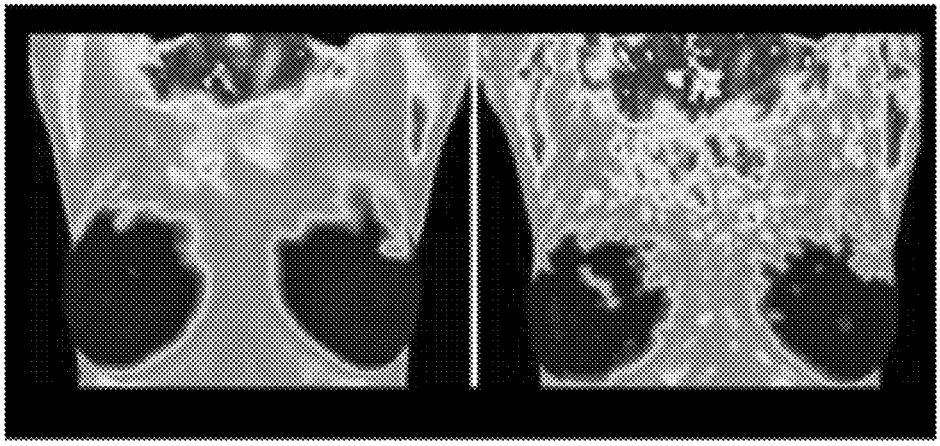

GARMENT FOR REDUCING HOT FLUSHES OR RELIEVING ASSOCIATED SYMPTOMS

The present application is a continuation application of U.S. application Ser. No. 16/470,718, filed on Jun. 18, 2019, which is a U.S. national stage entry under 35 U.S.C. § 371 of International Application No. PCT/SG2018/050498 filed on Oct. 2, 2018, which claims priority to United Kingdom Application No. 1716031.8 filed on Oct. 2, 2017.

FIELD OF INVENTION

The current invention relates to a device that can be used to attenuate symptoms associated with hot flushes/flashes. The device may be in the form of a garment, or may contain garment portions.

BACKGROUND

The listing or discussion of a prior-published document in this specification should not necessarily be taken as an acknowledgement that the document is part of the state of the art or is common general knowledge.

A hot flash, also known in some territories as a hot flush, is the most common symptom occurring in peri- through to post-menopausal women. Hot flashes affect between 75 to 80 percent of women during peri- through to post-menopause and may continue for a period of up to 10 years. Hot flashes are generally recognized by an initial feeling of intense warmth accompanied by sweating in several areas of the body, which is then followed by shivering or chills in most cases. It is believed that hot flashes occur in women experiencing perimenopause, menopause and post-menopause due in part to the fluctuation of estrogen levels. However, this fluctuation in estrogen levels does not appear to be sufficient to explain the symptoms completely. Additional factors that may bring on a hot flash include, warm ambient conditions, core body temperature elevation and peripheral heating. The effects of a hot flash occur in specific areas of the body and most commonly start from the upper chest area before propagating to the neck, back and face of the subject.

As with other homeotherms, humans generally maintain a core body temperature between an upper threshold for sweating 130 and a lower threshold 110 for shivering (FIG. 1A). Between these thresholds is a neutral, or thermoneutral, zone 120 within which major thermoregulatory adjustments (sweating and shivering) do not occur. The heat dissipation responses of subjects suffering from hot flashes are triggered if the core body temperature crosses the upper threshold of the thermoneutral zone. In contrast to asymptomatic individuals, subjects suffering from hot flashes appear to have a narrower thermoneutral zone 120, meaning that even small increases in the body's core temperature can trigger a hot flash (FIG. 1*b*).

It is believed that most hot flashes are triggered by a small increase in core body temperature resulting in a core body temperature above the sweating threshold of a symptomatic individual (e.g. see FIG. 1B). In order to prevent overheating, the body of a sufferer sends blood from the core of the body to the skin of the upper body to ensure fast heat removal by convection and wet heat conduction (heat transfer into sweat that evaporates), leading to an intense feeling of heat in the upper body of a sufferer. Once the body temperature cools sufficiently, the body stops pumping blood to the skin's surface reducing the skin's temperature. However, the sufferer has produced a significant amount of sweat that has not been removed during the hot flash and so as this sweat is removed the sufferer may experience chills and shivering as their core body temperature dips below the shivering threshold while the remaining sweat is evaporated. Significant discomfort is felt by the subject during a hot flash and so a range of treatment options have been developed that attempt to reduce or eliminate hot flashes with varying degrees of success.

The most effective treatment for hot flashes is hormone replacement therapy, which may use estrogen only or a combination of estrogen and progestin. However, many women prefer to avoid taking Hormone Replacement Therapy (HRT) for menopausal symptoms or have contraindications to this treatment. Other therapeutic agents that have been shown to be at least partly effective include selective serotonin reuptake inhibitors and serotonin-norepinephrine reuptake inhibitors, as well as gabapentin. However, these therapeutic agents may also give rise to side-effects that may limit their use in certain subjects. While other forms of therapy, including acupuncture, paced respiration (slow, deep, abdominal breathing), muscle relaxation techniques and biofeedback) have been shown to be at least partly effective in avoiding or reducing the effects of a hot flash by 50%, the reasons behind this effectiveness is not understood.

In the event that the person does not want to take HRT, there remains a need for alternative or better solutions that may help to manage a hot flash in subjects in need thereof.

US patent publication number 2008/0233368 describes an article that has a substrate that is coated in a number of discontinuous regions with a polymeric material in combination with two phase change materials, where said articles may be useful to a person suffering from a hot flash.

SUMMARY OF INVENTION

The current invention seeks to overcome at least some of the problems encountered when using the conventional solutions discussed above. Thus, in a first aspect of the invention, there is provided a wearable device for managing and/or reducing the symptoms of a hot flash in a subject, the device comprising:

- a first set of components, each comprising a fabric comprising a cooling yarn;
- a second set of components, each comprising a quick-dry wicking fabric; and
- a third set of components, each comprising a phase change material fabric, wherein
- the first set of components are adapted to cover at least a neckline region and a peripheral region that extends adjacently around the armpit and the clavicle of the subject;
- the second set of components are adapted to cover at least the abdominal muscles and the lumbar regions of the subject; and
- the third set of components are adapted to cover at least the mammary and the dorsum regions of the subject, wherein the cooling yarn is a yarn that has been shaped to provide a cooling effect on the skin.

In embodiments of the first aspect of the invention:

(a) the cooling yarn may be a yarn that induces a cooling sensation of from 0.4 to 3.0° C. (e.g. from 0.5 to 2.5° C., such as from 1.0 to 2.0° C.) to the body of user when worn;

(b) the cooling yarn may be a yarn selected from one or more of the group consisting of a nylon yarn, a polyethylene yarn, a polyester yarn, and combinations thereof. For example, the cooling yarn may be one or more of the group including but not limited to Nilit™ breeze, SportingTex™ cooling textile, Sorbtek™, Coolcore™, andCoolskin™;

(c) each cooling yarn may comprise an inorganic additive material selected from an oxide, silicate, sulfate or mixtures thereof;

(d) each cooling yarn may be formed from two or more threads that are constructed to remove water/sweat from the skin and then release it slowly from the core of the fabric by evaporation;

(e) the cooling yarn may form from 50% to 100% of the yarn content of the cooling yarn fabric;

(f) the first, second and third set of components may be formed in a single layer of yarn;

(g) the quick-dry wicking fabric may be a fabric that has inherent wicking properties or, more particularly, may be a fabric that has been treated to introduce or enhance wicking properties (e.g. the fabric may have been treated with one or more of the group selected from Hydro PAG™, Hydro PESG™, and TransDRY™, where the fabric may be made from a cooling yarn);

(h) the phase change material fabric may be a fabric that comprises a polymer film laminate layer that incorporates a phase change material (optionally wherein the polymer film further comprises a conduction-enhancing filler material selected from one or more of a metal, a carbon fiber, and a carbon nanotube); or comprises microcapsules comprising a phase change material (optionally wherein the microcapsules further comprises a conduction-enhancing filler material selected from one or more of a metal, a carbon fiber, and a carbon nanotube);

(i) the phase change material may be selected from one or more of the group including but not limited to linear crystalline alkyl hydrocarbons, fatty esters, long alkyl side chain polymers, the solid state series of pentaerythritol, pentaglycerine, neopentyl glycol, quaternary ammonium clathrates and semi-clathrates, salt hydrides or, more particularly, hydrated inorganic salts, linear long-chain hydrocarbons having formula $C_nH_{2n+2}$, where n is from 13 to 18, polyethylene glycol, and fatty acids;

(j) the phase change of the phase change material may occur at a temperature of from 29.5 to 39.0° C., such as from 29.5 to 38.0° C., such as from 30.0 to 35.0° C.;

(k) the phase change material fabric may be selected from one or more of the group including but not limited to HeiQ Smart Temp™, Outlast™, Schoeller™, and Croda™;

(l) the device may be in the form of a garment;

(m) the device may further comprise a fourth set of components adapted to provide a shaping effect on the body of a subject wearing the device, optionally wherein the fourth set of components are one or more of a friction band, rib knit fabric or compression mechanism;

(n) the device may further comprise, in one or more of the sets of components, one or more of the group selected from anti-odour agents, anti-microbial agents, anti-wrinkling agents and anti-piling agents.

In certain embodiments of the invention, the device may provide a minimum heat loss per $m^2$ under the following sweat rate conditions:

| | Heat loss requirement (per $m^2$) | | |
|---|---|---|---|
| Sweat Rate | Area covered by third set of components | Area covered by first and second set of components | Tolerance ($W/m^2$) |
| 0 $g/m^2$ hr | 121 $W/m^2$ | 121 $W/m^2$ | ±20 |
| 72 $g/m^2$ hr | 121 $W/m^2$ | 170 $W/m^2$ | ±30 |
| 100 $g/m^2$ hr | 121 $W/m^2$ | 188 $W/m^2$ | ±30 |
| 200 $g/m^2$ hr | 121 $W/m^2$ | 256 $W/m^2$ | ±40 |
| 300 $g/m^2$ hr | 121 $W/m^2$ | 323 $W/m^2$ | ±40 |
| 400 $g/m^2$ hr | 121 $W/m^2$ | 390 $W/m^2$ | ±50 |
| 500 $g/m^2$ hr | 121 $W/m^2$ | 457 $W/m^2$ | ±50 |

In some embodiments of the invention, a fabric comprising a cooling yarn which has inherent wicking properties or has been treated to introduce or enhance wicking properties may form the first and second sets of components and may be adapted to cover at least the regions covered by the first and second sets of components as defined above.

In certain embodiments of the invention, a fabric comprising a cooling yarn and a phase change material may form the first and third sets of components and may be adapted to cover at least the regions covered by the first and third sets of components as defined above.

In some other embodiments of the invention, a fabric comprising a quick-dry wicking fabric and a phase change material may form the second and third sets of components and may be adapted to cover at least the regions covered by the second and third sets of components as defined above.

In further embodiments of the invention, a fabric comprising a cooling yarn, a phase change material and which has inherent wicking properties or has been treated to introduce or enhance wicking properties may form the first to third sets of components, such that the combined fabric may be adapted to cover at least all regions as defined above.

In yet further embodiments of the invention, the fabric forming the first to third sets of components may be formed using Nilit™ breeze, coated with Hydro PAG™ and Smart Temp™.

In a second aspect of the invention, there is provided a method of reducing and/or managing the symptoms of a hot flash in a subject, wherein the method comprises wearing the device according to the first aspect of the invention and any technically sensible combination of its embodiments.

DRAWINGS

FIG. 1 depicts: (a) a typical asymptomatic thermoneutral zone; and (b) the thermoneutral zone of a subject who suffers from hot flashes.

FIG. 2 depicts: (a) an infra-red heat map of a subject before/at the beginning phase of a hot flash; and (b) an infra-red heat map of a subject towards/at the peak of a hot flash.

DESCRIPTION

Figure 3:
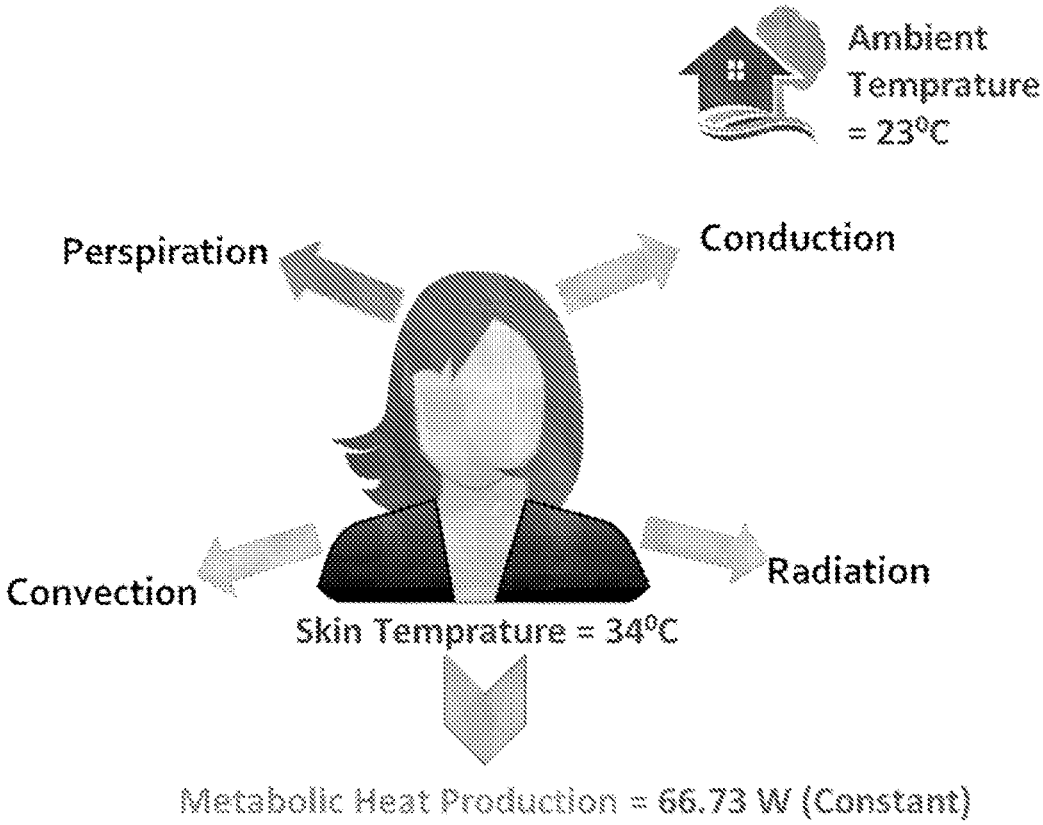
FIG. 3 depicts the physiology and behaviour of a subject under low-temperature ambient conditions.

It has been surprisingly found that a combination of different materials may be useful in managing and/or reducing the symptoms associated with a hot flash. To that end, disclosed herein is a wearable device for managing and/or reducing the symptoms of a hot flash in a subject, the device comprising:

a first set of components, each comprising a fabric comprising a cooling yarn and/or a cooling apparatus;

a second set of components, each comprising a quick-dry wicking fabric; and a third set of components, each comprising a phase change material fabric, wherein the first set of components are adapted to cover at least a neckline region and a peripheral region that extends adjacently around the armpit and the clavicle of the subject;

the second set of components are adapted to cover at least the abdominal muscles and the lumbar regions of the subject; and the third set of components are adapted to cover at least the mammary and the dorsum regions of the subject, wherein the cooling yarn is a yarn that has been shaped to provide a cooling effect on the skin.

When used herein in the context of the first to third sets of components, the phrase "at least" is used to specify that each of the first to third sets of components must cover the specified minimum area defined, but that it may cover a broader area—up to and including areas associated with the other component sets. For example, the first set of components may cover the entire device, while the second and third sets of components may be restricted to the specified areas above, such that the first set of components is used in combination with the second set of components and the third set of components. As will be apparent, it is specifically contemplated herein that one or more of the first to third sets of components may only cover the respective minimum area defined for that set of components. Further possible combinations of components are described in embodiments of the invention discussed in more detail hereinbelow.

In embodiments herein, the word "comprising" may be interpreted as requiring the features mentioned, but not limiting the presence of other features. Alternatively, the word "comprising" may also relate to the situation where only the components/features listed are intended to be present (e.g. the word "comprising" may be replaced by the phrases "consists of" or "consists essentially of"). It is explicitly contemplated that both the broader and narrower interpretations can be applied to all aspects and embodiments of the present invention. In other words, the word "comprising" and synonyms thereof may be replaced by the phrase "consisting of" or the phrase "consists essentially of" or synonyms thereof and vice versa.

The term "fabric" when used herein includes woven fabrics, knit fabrics, nonwoven fabrics, multilayer fabrics, and the like.

When used herein, a "cooling yarn" refers to a yarn that provides a passive cooling effect on the skin surface. For example, a cooling yarn may induce a cooling effect of from 0.4 to 3.0° C. to the body of user when worn. For example, the cooling effect may be from 0.5 to 2.5° C., such as from 1.0 to 2.0° C. to the body of user when worn. Cooling yarns that may be mentioned herein may include one or more of the group consisting of a nylon yarn, a polyethylene yarn, a polyester yarn, and blend thereof that have been shaped appropriately or may refer to a combination of materials that have been constructed in a particular manner to include a cooling effect (e.g. two threads that are constructed to form a yarn that removes water/sweat from the skin and then release it slowly from the core of the fabric by evaporation). Suitable specific cooling yarns that may be mentioned herein include Nilit™ breeze, SportingTex™ cooling textile, Sorbtek™, Coolcore™, and Coolskin™.

Nilit™ Breeze is a polyamide yarn (e.g. Nylon 66) available from Nilit Ltd of Israel that contains an inorganic additive (e.g. an oxide, a silicate, a sulfate or mixtures thereof, such as $TiO_2$) in an amount of between 0.3 and 3.0 wt % and is characterised by a low crimp modulus and a flat cross section. The crimp modulus may be from 1 to 4 (or between 1 and 4) and the cross-section may have an aspect ratio of from 3:7 to 6:7 (or between 3:7 and 6:7). More details on Nilit™ Breeze and its variants, which may also be used in the current invention, are provided in US patent publication No. US 2015/0013047, which is incorporated herein by reference. For example, in embodiments of the invention the cooling yarn may be one set out in the following lettered clauses.

A. A yarn for cooling the skin of a wearer, the yarn:

i) comprising a polyamide;

ii) having a crimp modulus of between 1 and 4; and iii) having a flat cross-section characterized by an aspect ratio of between 3:7 and 6:7, wherein a fabric formed from said yarn provides a surface temperature reduction of from 0.4 to 0.6° C. when tested on an inanimate manikin model.

B. The yarn according to Clause A, wherein said polyamide is Nylon 66.

C. The yarn according to Clause A or B, containing Nylon 66 and an inorganic additive.

D. The yarn according to any one of Clauses A to C, comprising Nylon 66 and an inorganic additive selected from oxides, silicates, sulfates, and their mixtures.

E. The yarn according to any one of Clauses A to D, comprising Nylon 66 and an inorganic additive, where the inorganic additive is present in an amount of from 0.3 wt % to 3.0 wt %.

F. The yarn according to any one of Clauses A to E, having a titer of from 17 dtex to 78 dtex.

G. The yarn according to any one of Clauses A to F, containing titanium dioxide.

The crimp modulus is from 1 to 4, whereas usual values are from 6 to 14. The crimp and bulkiness of said cooling yarn is lower than in normal in a textured nylon. Such a cooling yarn has a flat cross-section that can be provided using the texturing procedure set out in Example 1 of US 2015/0013047, which is hereby incorporated by reference. This procedure does not distort the filament shape and so its cross-section is maintained. This procedure also provides a yarn having a disk configuration of 1-2-1, compared to the standard 1-7-1 configuration.

The elastic property measurements of the textured yarns described above may be performed using a Texturmat (TEX-TECHNO, Germany), and the crimp modulus may be measured as the percentage shrinkage of the textured yarn. The crimp modulus is usually more than 7% in normal yarns, often up to 20% and more. When used herein, a flat cross-section is characterized as an aspect ratio. When used herein, aspect ratio is the ratio between the minimal linear dimension of the cross-section and its maximal linear dimension; for example, the aspect ratio of an elliptic cross-section would be the ratio between the minor axis and the major axis of the ellipse. The aspect ratio of a cooling yarn as described in this section is usually between 3:7 and 6:7.

Coolskin™ and Coldskin™ are microfiber-based materials available from Garmatex Technologies, Inc., Canada. Sorbtek™ is a polyester based material available from Unifi, USA. SportingTex™ cooling textile is a fabric comprising a mineral incorporated within the fabric and is available from Sun Dream Enterprise Co. Ltd., Taiwan.

Coolcore™ is a fabric that has been peached on both the front and back sides of the fabric and may be formed from a yarn blend of polyester and nylon (e.g. from 65 to 85% polyester and from 35 to 15% nylon), with the warp yarns having a thickness of from 50 to 100 denier and the weft yarn having a thickness of from 125 to 175 denier and a fiber count ranging from 50 to 175. More details on Coolcore™ and its variants, which may also be used in the current invention, are provided in U.S. Pat. Nos. 8,440,119 and 9,121,642, which are incorporated herein by reference. Coolcore™ may be obtained from Coolcore, New Hampshire, USA.

Other materials that may be suitable for use as the cooling yarn includes a fabric or yarn that has been treated so that it has a polymeric membrane attached to the substrate yarn or fabric, which membrane contains active particles. For example, the polymeric membrane may be a polyurethane and the active particles may be activated carbon particles. More details on this material and its variants, which may also be used in the current invention, are provided in U.S. Pat. No. 8,945,287, which is incorporated herein by reference. However, in preferred embodiments mentioned herein, the cooling yarn does not include a membrane.

For the avoidance of doubt, when used herein, "cooling yarn" is not intended to relate to materials such as superabsorbent polymers, whether as yarn material themselves or used as an additive material on the surface or core of a yarn.

A cooling yarn is used in embodiments of the invention, specifically as the first set of components of the device described herein. The cooling yarn may be present in an amount of from 50 to 100% of the resulting fabric. For example, the cooling yarn may compose from 75 to 100% of the fabric. Particular cooling yarns that may be mentioned in embodiments of the invention herein is Nilit™ Breeze and a yarn or fabric that has been coated with a polymeric membrane that incorporates active particles (e.g. polyurethane and activated carbon particles).

Optionally, the device includes a cooling apparatus used in addition to or in place of the cooling yarn for the first set of components. When used herein, "cooling apparatus" refers to a device that provides active cooling to a subject. This may be accomplished by a circulating liquid cooled apparatus, a metal wire or patch attached to a cooling source, one or more Peltier devices and the like.

When used herein, "quick-dry wicking fabric" refers to a fabric that removes water/sweat from the skin and enables rapid evaporation from the fabric thereafter. More specifically, "wicking" refers to absorbing effect of a fabric by capillary action, which can be measured using AATCC 197 (Option B; vertical wicking of textiles). In the current invention the quick drying wicking fabric should have a wicking rate that is greater than 3 mm per minute in a width direction of the fabric and from 7 mm to greater than 20 mm (e.g. from 7 to 20 mm, such as from 10 to 15 mm) per minute in a lengthwise direction of the fabric. The quick drying wicking fabric should have a drying rate of from 0.5 ml/h to 5 ml/h as measured using AATC 201; Drying rate—Heated plate method.

The quick-dry wicking fabrics used herein may be a fabric that has inherent wicking properties (i.e. quick-drying wicking properties) or a fabric that has been treated to introduce or enhance said properties. It will be appreciated that any suitable fabric may be treated with a quick-drying wicking treatment to provide a suitable quick-drying wicking fabric. Such materials may include materials comprising the cooling yarns above, which may not otherwise provide a sufficient wicking effect. Suitable quick-drying wicking treatments that may be used to provide the quick-drying wicking fabrics used in embodiments herein include Hydro PAG™ and Hydro PESG™ from Heiq AG, Switzerland and Transdry™ from Cotton Incorporated, USA, which materials may be used individually or in any combination. Hydro PAG™ is intended to treat nylon fabrics, Hydro PESG™ is intended to treat polyester fabrics and Transdry™ is intended to treat cotton fabrics, but it is contemplated that the set reatments (or combinations thereof) may be applied to different fabric materials than just those it is intended to treat, provided that the resulting treated fabric is a quick-drying wicking fabric as defined herein. Alternatively, Transdry™ may be provided as a treated cotton fabric from transdry, in which case the treated cotton may be used as a separate component for quick-dry wicking only.

A quick-dry wicking fabric is used in embodiments of the invention, specifically as the second set of components of the device described herein. As will be appreciated, when a cooling yarn fabric is treated with one of the quick-drying wicking treatments described above, it will incorporate both the desired wicking and quick-drying wicking properties in a single material. Such a material may therefore be used as the first and second sets of components of the device described herein.

When used herein a "phase change material" refers to a material that changes from one phase to another (e.g. between solid and liquid) at a temperature of from 29.5 to 39.0° C.

Other suitable temperature ranges for the phase change transition to occur may be from 29.5 to 38.0° C., such as from 30.0 to 35.0° C. It is believed that a phase change within the temperature ranges provided above may not only help to reduce the duration of the hot flash by helping to remove heat quickly from the body, but also help to reduce or manage shivering after the hot flash has passed. This latter functionality is due to the ability of the phase change material to radiate at least some of the heat stored by the phase change back towards the body, which may also result in the phase change material returning to its original phase (e.g. returning to a solid phase from a liquid phase).

Suitable phase change material fabrics may be a fabric that comprises a polymer film laminate layer that incorporates a phase change material; and/or may comprise microcapsules comprising a phase change material. Suitable phase change materials that may be mentioned herein include, but are not limited to linear crystalline alkyl hydrocarbons, fatty esters, long alkyl side chain polymers, the solid state series of pentaerythritol, pentaglycerine, neopentyl glycol, quaternary ammonium clathrates and semi-clathrates, salt hydrides or, more particularly, hydrated inorganic salts, linear long-chain hydrocarbons having formula $C_nH_{2n+2}$, where n is from 13 to 18, polyethylene glycol, and fatty acids, and combinations thereof. More details on suitable phase change materials, which may also be used in the current invention, are provided in US patent publication Nos. US 2007/0193278 and US 2012/0015155, which are incorporated herein by reference. In certain embodiments, the microcapsules or polymer film may further comprise a conduction-enhancing filler material selected from one or more of a metal, a carbon fiber, and a carbon nanotube.

Further examples of phase change materials include a variety of organic and inorganic substances, such as but are not limited to, alkanes, alkenes, alkynes, arenes, hydrated salts (e.g., calcium chloride hexahydrate, calcium bromide hexahydrate, magnesium nitrate hexahydrate, lithium nitrate trihydrate, potassium fluoride tetrahydrate, ammonium alum, magnesium chloride hexahydrate, sodium carbonate decahydrate, disodium phosphate dodecahydrate, sodium sulfate decahydrate, and sodium acetate trihydrate), waxes, oils, water, fatty acids, fatty acid esters, dibasic acids, dibasic esters, 1-halides, primary alcohols, clathrates, semi-clathrates, gas clathrates, anhydrides (e.g., stearic anhydride), ethylene carbonate, polyhydric alcohols (e.g., 2,2-dimethyl-1,3-propanediol, 2-hydroxymethyl-2-methyl-1,3-propanediol, ethylene glycol, pentaerythritol, dip entaerythritol, pentaglycerine, tetramethylol ethane, neopentyl glycol, tetramethylol propane, 2-amino-2-methyl-1,3-propanediol, monoaminopentaerythritol, diaminopentaerythritol, and tris(hydroxymethyl)acetic acid), polymers (e.g., polyethylene, polyethylene glycol, polyethylene oxide, polypropylene, polypropylene glycol, polytetramethylene glycol, polypropylene malonate, polyneopentyl glycol sebacate, polypentane glutarate, polyvinyl myristate, polyvinyl stearate, polyvinyl laurate, polyhexadecyl methacrylate, polyoctadecyl methacrylate, polyesters produced by polycondensation of glycols (or their derivatives) with diacids (or their derivatives), and copolymers, such as polyacrylate or poly(meth)acrylate with alkyl hydrocarbon side chain or with polyethylene glycol side chain and copolymers including polyethylene, polyethylene glycol, polyethylene oxide, polypropylene, polypropylene glycol, or polytetramethylene glycol), metals, and mixtures thereof. More details on these examples of phase change materials, which may also be used in the current invention, are provided in US patent publication No. US 2008/0233368, which is incorporated herein by reference. It will be appreciated that preferred PCMs are those that have a phase change transition temperature within the temperature ranges described above.

A phase change material fabric is used in embodiments of the invention, specifically as the third set of components of the device described herein. Particular phase change materials that may be mentioned herein include HeiQ Smart Temp™, Outlast™, Schoeller™, Croda™ and combinations thereof. As will be appreciated, these materials are coatings that may be applied onto a pre-existing fabric, as discussed in more detail below.

Smart Temp™ is a hydrofunctional polymeric coating that may be applied to a fabric substrate. Smart Temp™ may be obtained from HeiQ, Switzerland. Outlast™ or Themocules™ are a fabric material that consists of microparticles having a shell surrounding a phase change material and coatings for fabrics and fabrics may be obtained from Outlast Europe GmbH, Germany. Schoeller™ phase change materials are similar to Outlast materials in that they appear to consist of microparticles having a shell surrounding a phase change material, fabrics or coating materials may be obtained from Schoeller Textile AG, Switzerland. Croda™ phase change materials may be obtained from Croda International, UK.

Thus, the phase change material mentioned herein may be provided as microparticles that are coated onto a fabric and do not form part of a separate layer. In certain embodiments, the coating of microparticles may be applied to a cooling yarn to provide a material that may act as both the first and third sets of components. In further embodiments, the coating of microparticles may be applied to a quick-drying wicking fabric to provide a material that may act as both the second and third sets of components. In still further embodiments, the cooling yarn may be treated with a quick-drying wicking treatment and coated with the microparticles, such that the resulting material may act as all of the first to third sets of components.

The phase change materials mentioned herein therefore can be incorporated either as part of as fully-formed fibre or by the coating of a fabric. A coating may be incorporated either directly on the surface of a substrate material or may be used in conjunction with the substrate material, for example, by being entrained, immersed or otherwise contained within the substrate. In general, the coating can be either on the surface or within the interstices of the substrate. The substrate may be formed of any suitable material, such as a fibrous material or a polymer. Thus, for example, the substrate can be a natural or synthetic fibre (e.g., a fibre formed of polyester, polyamide, polyacrylic, polylactic acid, polyolefin, polyurethane, natural or regenerated cellulose, silk, wool or the like), a natural or synthetic filament, a yarn formed of natural or synthetic fibres, or a fabric formed of natural or synthetic fibres (e.g., a knitted fabric, a woven fabric, or a non-woven fabric).

As noted above, the current invention relates to a wearable device (e.g. a garment) comprising a combination of elements that may help to manage or reduce the symptoms associated with hot flashes in a subject. Without wishing to be bound by theory, the device may contain up to three discrete sections with different properties that target three specific regions of the body, or may contain a blended material that is effective in all of the targeted regions. The different properties are provided by up to three different sets of components of the device as a result of the materials used in the components. Specifically, the first set of components provides passive cooling effect properties, the second set of components provides quick-drying wicking properties, and the third set of components provides phase changing properties. In one example, the device has three discrete sections corresponding to the three sets of components that target three specific body regions, such that each body region experiences the properties provided by the respective set of components. In another example, two or all of the three sets of components are blended or combined together, such as formed together in a single layer of yarn, such that they collectively provide the properties of the combined sets of components at the targeted body section(s). In other words, the device comprises a combination of all three sets of components that provides all of the passive cooling effect, quick-drying wicking, and phase changing properties throughout the device. It will thus be appreciated that the various sets of components may operate individually or in combination and to target various body sections as desired.

Two of the targeted regions can be illustrated by an infra-red heat map of a subject at the start of and during a hot flash (FIGS. 2A and 2B). As seen in FIG. 2A the neck and chest of the subject have become warm relative to the rest of the body. Towards/at the peak of the hot flash (FIG. 2B), the hot flash has propagated from the area around the neck and upper chest into the armpit region, which all experience significant heat build-up, while the lower chest region experiences a rise in temperature, it is not as extreme as that in the upper neck and armpit regions.

When used herein, the term "perimenopause" refers to the period of time between the last regular menstrual period and the last menstrual period of a subject. The term "menopause" refers to the period of 12 months beginning with the last menstrual period of a subject, while the term "postmenopause" refers to the period beginning from 12 months after the last menstrual period of a subject.

Without wishing to be bound by theory, it is believed that in a subject that displays hot flashes the thermoneutral zone in the subject has become narrower than normal (FIG. 1B versus FIG. 1A), making them more susceptible to changes in the environment around them.

Thermal regulation of the human body is the sum of metabolic heat produced by the body and heat loss to the environment or through biological control mechanisms. Environmental heat loss may occur through radiation of heat from the body into a cooler environment, convention (heat loss due to the movement of air in the environment surrounding the body), and conduction (heat flowing from the body to a cooler object in direct contact with the body).

As such, heat loss through environmental means is primarily through dry heat transfer and this is the primary form of heat transfer when the environment surrounding the body is significantly cooler than the body of the subject. However, when the subject is placed in an environment close to or above the body's temperature, the environmental mechanisms of heat loss either do not operate to remove heat efficiently or are reversed and supply heat to the body, in which case the body relies on sweating to remove heat from the body. Sweating acts to cool the body down by evaporation, which is primarily a form of wet heat transfer. In general, assuming that no exercise is being undertaken, dry heat transfer mechanisms predominate at temperatures of less than 30° C., while the wet heat transfer mechanism starts to predominate at temperature of from 32° C. and above.

In a typical person, the basal heat production value is around 67 W (e.g. 66.73 W based on the Harris-Benedict equation), based upon a seated and relaxed person having a skin surface area of 1.8 $m^2$ and weighing 70 kg.

Figure 4:
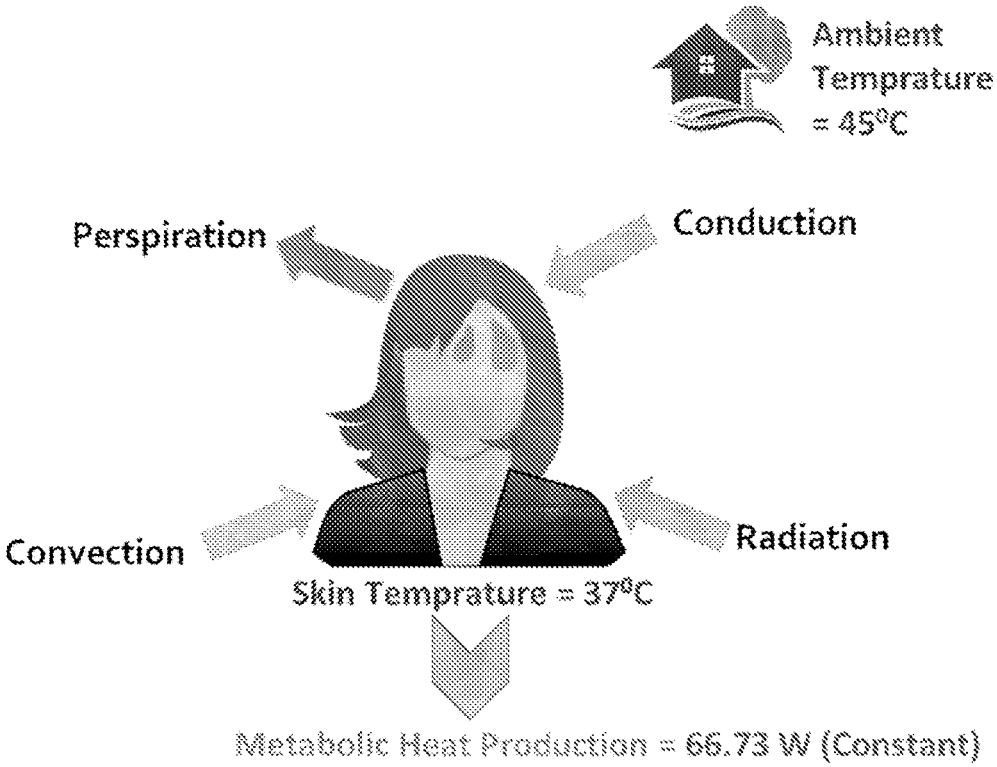
FIG. 4 depicts the physiology and behaviour of a subject under high-temperature ambient conditions.

Thus, when the ambient temperature is around 23° C. (FIG. 3), the skin temperature of the typical person will be around 34° C. and the person will lose heat mainly by conduction, radiation and convention, with some perspiration (around 25 g per hour). When the same person (FIG. 4) experiences a high temperature environment of 45° C. and a wind speed of 0.2 m/s, they will only lose heat by perspiration (as heat transfer by conduction (6.8 W), convention (45.5 W) and radiation (98.2) will provide heat into the body rather than away from the body), leading to a skin temperature of 37° C. To cancel this effect the body must lose around 217.2 W of heat by sweating, which translates into a sweating rate of around 322 g per hour to maintain normal body temperature.

Figure 5:
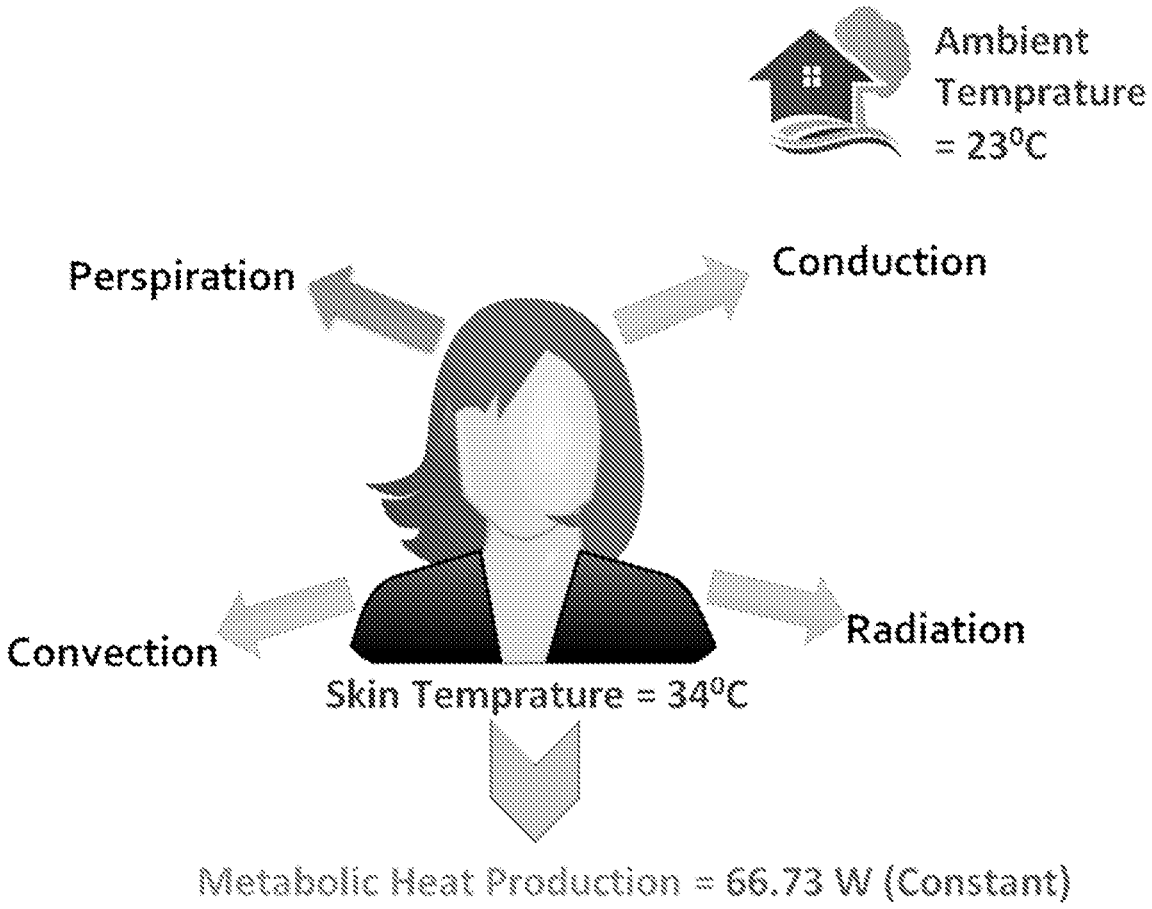
FIG. 5 depicts the physiology and behaviour of a hot flash under ambient conditions (27° C.).

For a typical person who suffers from a hot flash (e.g. 51 year old female of weight and skin area noted above), even though the ambient conditions are lower in temperature than the skin, it appears that the control mechanism contained within the hypothalamus malfunctions leading to a response similar to that found in a non-sufferer exposed to high ambient temperature environment, except in this case the dry heat loss mechanisms are also operable. For example as shown in FIG. 5, the sufferer may experience a hot flash in environments with slightly raised ambient temperature conditions, such as 27° C. and a wind speed of 1 m/s. Even though the sufferer's skin temperature is 34° C., the hypothalamus malfunction leads to an increased heartrate and blood flow to the skin, leading to the activation of both the dry and wet heat loss mechanisms, which all function to remove heat from the body (perspiration (87.4 W), convention (134.46), radiation (77.62 W) and conduction (6.01 W)), with priority given to perspiration. As such, the sweating rate for the typical subject is around 129 g per hour during a hot flash (or about 2.88 g per hour on a testing apparatus having an area of 0.04 $m^2$). Thus, during a hot flash under these conditions, the perspiration heat loss requirement in Watts is 87.4 W for a sweating rate of 129 g per hour for a subject of 1.8 $m^2$. If the sweating rate in the hot flash is higher, the heat loss requirement also increases. For example, for the same subject, a sweating rate of 180 g per hour requires a perspiration heat loss of 121 W, while a sweating rate of 360 g per hour requires a perspiration heat loss of 242 W. Table 1 provides a model based on the above information provides the required heat loss for regions of the body under normal conditions (0 $g/m^2$ hr) and during a hot flash.

TABLE 1

| | Heat loss requirement (per $m^2$) | | |
|---|---|---|---|
| Sweat Rate | Lower Chest/Mammary Gland Region/ corresponding portion of back | Neck (front and back), armpit, abdominal muscles and lumbar regions | Tolerance ($W/m^2$) |
| 0 $g/m^2$ hr | 121 $W/m^2$ | 121 $W/m^2$ | ±20 |
| 72 $g/m^2$ hr | 121 $W/m^2$ | 170 $W/m^2$ | ±30 |
| 100 $g/m^2$ hr | 121 $W/m^2$ | 188 $W/m^2$ | ±30 |
| 200 $g/m^2$ hr | 121 $W/m^2$ | 256 $W/m^2$ | ±40 |
| 300 $g/m^2$ hr | 121 $W/m^2$ | 323 $W/m^2$ | ±40 |
| 400 $g/m^2$ hr | 121 $W/m^2$ | 390 $W/m^2$ | ±50 |
| 500 $g/m^2$ hr | 121 $W/m^2$ | 457 $W/m^2$ | ±50 |

The model of Table 1 defines two general regions, though these regions may be sub-divided further as discussed below. While regions of the lower chest, mammary glands and the corresponding regions of the back increase in temperature during the hot flash (FIG. 2), the increase is not as extreme as the upper neck and under-arm areas. Given this, in the currently claimed invention, these regions may be particularly suited to the use of a fabric containing a phase change material. This is because as the subject experiences the hot flash, the phase change material can be used to absorb and remove heat from the body of the subject and then release at least part of the absorbed heat back to the body once the hot flash is subsided. This may help to preserve the core temperature of the body and manage or reduce the shivering episodes that occur after a hot flash.

The neck and armpit regions suffer intense heat production during a hot flash, but do not necessarily produce a significant amount of sweat (e.g. due to the use of antiperspirants). As such, for the neck and armpit regions, it is believed to be important that they are covered with a material that can provide a cooling effect during the hot flash, such as a cooling yarn fabric or an active cooling apparatus.

The abdominal muscle region and lumbar regions produce a significant amount of sweat, but do not necessarily experience a significant increase in temperature. As such, it is believed that enabling the sweat to be removed and evaporated quickly helps to achieve cooling to reduce the effects of the hot flash and, due to the quick evaporation, reduces the residual effects of the sweating on the core temperature of the body after the hot flash has passed. This may help to reduce or eliminate the period of shivering that commonly follows a hot flash.

The devices of the current invention aim to provide appropriate materials, whether alone or in combination, that can provide the desired effects to each of the regions identified above. The application of a device (e.g. a garment) that targets the specific issues of each of the regions above may assist a subject susceptible to hot flashes suffer less extreme symptoms or even prevent hot flashes all together. To that end, the device of the current invention provides a cooling material or a cooling apparatus that is situated at least around the neck region and around the armpit region of the subject, a quick-drying wicking material at least around the abdominal muscles and lumbar regions of the subject and a phase change material at least in the region around the lower chest an mammary glands of the subject. Each material has been provided to serve a specific purpose within the device, which matches the region(s) of the body that they are in close proximity to when in use. An embodiment of the invention which will be used to illustrate the placement and use of these materials is provided in FIG. 6.

Figure 6:
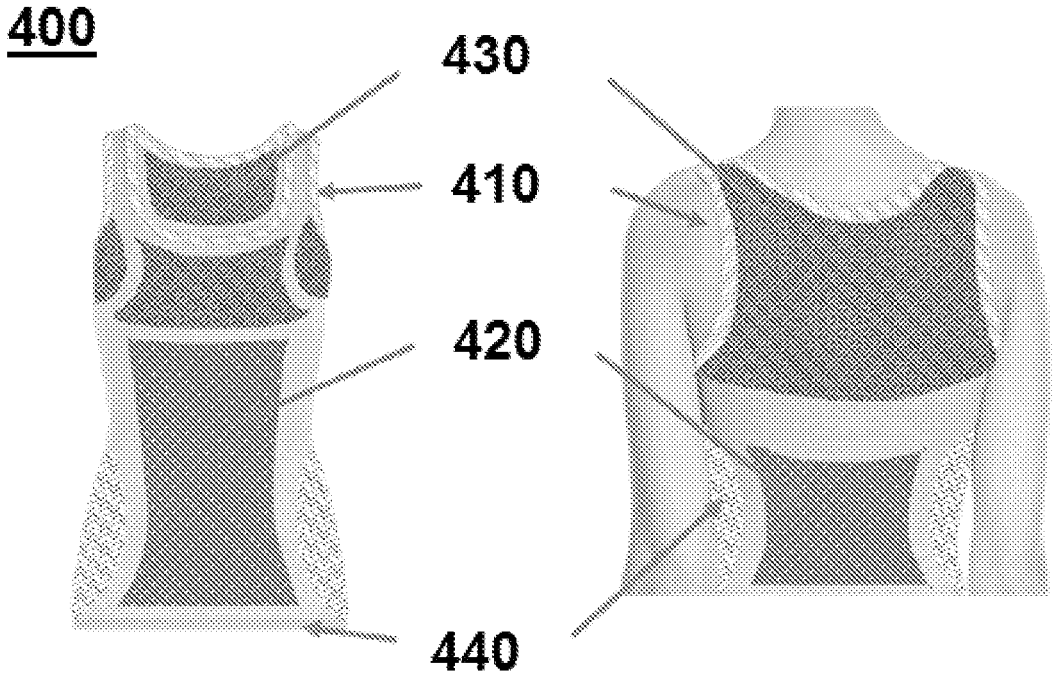
FIG. 6 depicts and embodiment of the current invention.

In FIG. 6, there is provided a garment 400 having four sets of components, labelled as elements 410 to 440, respectively. Element set 440 is a shaping element that may be provided in some embodiments of the invention to provide a shaping effect on the body of a subject wearing the device. For example, element set 440 may be one or more of a friction band, rib knit fabric, other knitting structures or a compression mechanism (e.g. changing the modulus of the fabrics used across various parts of the device). It will be appreciated that element set 440 is entirely optional and it is intended, when present, to ensure that the different compression levels required across the device are achieved, such that the device fits to the surface of the skin snugly.

Element set 410 in the embodiment of FIG. 6 is positioned in such a way that it approximately covers the neckline/upper chest of the subject and it also covers a peripheral region that extends from the collar bone (clavicle) to the armpit region. Element set 410 is therefore provided as three components in FIG. 6 and each is made from a material that comprises a cooling yarn or is a cooling apparatus. Element set 420 in the embodiment of FIG. 6 is positioned to cover at least the abdominal muscle region and the small of the back, or lumbar region. Element set 420 is thus provided as two components in FIG. 6 and each is made from a quick-dry wicking fabric. Element set 430 in the embodiment of FIG. 6 is positioned to cover the mammary and the dorsum regions of the subject. Element set 430 is thus provided as two components in FIG. 6 and is made of a phase change material fabric. It will be appreciated that each of the materials listed above may be selected from the functional materials an apparatus disclosed herein, though other functional equivalents may also function equally well.

In the embodiment of FIG. 6 therefore, there is provided an element set 410 that acts to maintain ambient conditions for the subject in areas that produce excessive heat, an element set 420 that helps to wick away and evaporate sweat that is produced during a hot flash (thereby helping prevent a fall in the core temperature of the body) and an element set 430 of a temperature regulating materials that helps to reduce the severity of the hot flash by absorbing heat and then radiating at least part of said absorbed heat back to the body to help maintain skin temperature following the end of the hot flash. In addition, element set 440 may be present, which may help to shape the body and/or anchor the other element sets in place. In the embodiment shown in FIG. 6, each of the element sets may be distinct materials brought together to form a wearable device that provides a synergistic effect that may help to manage or reduce the symptoms of a hot flash. In terms of management, element sets 410 and 420 may each help to reduce the effects of ambient conditions on the wearer, such that they are effectively insulated from the environment and can maintain their body temperature within the narrowed thermoneutral zone. In terms of reducing or minimising the effects of the hot flash, element sets 410 to 430 operate cooperatively to effectively maximise heat loss from the body and then element sets 420 and 430 help to reduce shivering episodes thereafter, either by effectively evaporating moisture from the material (element set 420) or returning heat to the body of a wearer (Element set 430).

As will be appreciated, when element set 410 is a fabric that contains a cooling yarn, each of the element sets (including element set 440, when provided) may be attached to one another to form a garment.

It will be appreciated that the cooling yarn fabric of element set 410 may be constructed of solely cooling yarn materials, but it may also contain other materials that may provide additional functionality. For example, the cooling yarn fabric of element set 410 may also contain Spandex™ to provide stretchiness or it may contain natural yarn fibers (e.g. cotton) to generate desired tactile requirements. However, the cooling yarn should form from 50% to 100% of the yarn content of the cooling yarn fabric, such as from 75% to 100% of the yarn content. It will be appreciated that the amount of cooling yarn in the cooling yarn fabric mentioned here may be generally applicable in embodiments of the invention as discussed below where the cooling yarn fabric may be used as a base material for other element sets.

It will also be appreciated that the elements sets described above must cover as a minimum the designated regions specified and that it is possible for the elements sets to be blended together in certain circumstances. For example, in certain embodiments of the invention, the device may be a garment that is entirely constructed of a fabric that contains a cooling yarn. The fabric may then be entirely treated with coating materials, so that it also contains a phase change material and also provides a quick-drying wicking effect (e.g. the garment may be constructed entirely from Nilit™ breeze that has been treated with Heiq Hydro PAG™ and Smart Temp™ coating materials. In some other embodiments, the device may be a garment that is entirely constructed of a quick-dry wicking fabric that is entirely treated by coating with a phase change material.

In yet further embodiments of the invention, it will be appreciated that two or three of the element sets may be blended in one or two of the defined regions, while another region may contain one or two blended elements sets. For example, the upper torso (i.e. neck region and lower chest/mammary region, armpit regions and corresponding regions of the back) may be formed from the blending of element sets 410 and 430 together (e.g. a cooling yarn fabric treated so that it contains a phase change material), from the blending of element sets 420 and 430 together (e.g. a quick-dry wicking fabric treated so that it contains a phase change material), or from the blending of element sets 410 to 430 together (e.g. a cooling yarn fabric containing a phase change material and a quick-drying wicking coating material), while the lower portion of the torso (i.e. abdominal muscle and lumbar regions) may be formed from only element set 420 (e.g. a quick-drying wicking material, such as Transdry™) from a combination of element sets 410 and 420 (e.g. a cooling yarn fabric containing a quick-drying wicking coating material), or from a combination of element sets 420 and 430. An embodiment of the invention where all areas of the device comprise element sets 410 to 430 is described in more detail in the experimental section below.

In embodiments of the invention:

- the cooling yarns of element set 410 may be integrated into the device by knitting, sewing or through a chemical application (e.g. chemically treating a pre-existing yarn to have a cooling effect) onto the desired areas indicated hereinbefore;
- the quick drying materials of element set 420 may be applied in the form of a specific quick drying fabric in at least the areas of the device noted hereinbefore or by any other suitable method of introducing a quick drying wicking treatment to the device (e.g. by chemical or physical treatment of a fabric);
- the phase change materials of element set 430 may be introduced in such a way as to ensure maximum contact with human skin as possible in all areas that these materials are included in the device. Phase change materials may be introduced by applying a coating to a pre-existing fabric (e.g. such as by, but not limited to, coating, painting, dipping and the like). The element sets 410 to 430 can be used individually, or two or more element sets can be blended together, in respective regions of the device to target various regions of the body.

It will be appreciated that any of the fabric mentioned herein may also contain anti-odour agents, anti-microbial agents, anti-wrinkling agents, anti-piling agents and combinations thereof. Anti-microbials that may be mentioned herein include arsenic compounds, sulfur, copper compounds, isothiazolins phthalamides, carbamates, silver base inorganic agents, silver zinc zeolites, silver copper zeolites, silver zeolites, metal oxides, and silicates. Other additives that may be included are colorants, pigments, dyes, fluorescent whitening agents or optical brighteners (e.g., bis-benzoxazoles, phenylcoumarins, and bis-(styryl)biphenyls), and so forth. These agents/additives may be dispersed uniformly, or non-uniformly, within the coating. Typically, the one or more additives will be selected to be sufficiently non-reactive with the temperature regulating effects described above, so that a desired temperature range is maintained.

Particular embodiments of the current invention (and parts thereof) will now be discussed in the following examples. It is to be understood that these embodiments are not intended to be limiting on the scope of the claimed invention.

EXAMPLES

Example 1

The measurement of cooling effects was performed on the Hohenstein Heat Release Tester "WATson", which simulates the heat management of the human skin in a climatic chamber under defined climatic conditions. The measurements were conducted with the parameters found in Table 2. The WATson test apparatus is available from the Hohenstein Institut für Textilinnovation gGmbH, Schloss Hohenstein, 74357 Bönnigheim, Germany.

TABLE 2

| | |
|---|---|
| Temp. of WATson measuring head | $T_s$ = 34° C. |
| Area of WATson measuring head | $A_w$ – 400 $cm^2$ (20 × 20 cm) |
| Ambient climate in the climate chamber | $T_a$ = 27° C., $RH_a$ = 70% |
| Environmental condition 1 | Wind (1 m/s); IR-radiation @ 13.2 W |
| Sweat glands | 4 (inner glands) |
| Sweat rate and sequence | 4-8 g/h |
| dry/no pumps | t = 0-10 min |
| sweating, SWR 4 g/h | t = 10-15 min |
| dry/no pumps | t = 15-35 min |
| sweating, SWR 8 g/h | t = 35-40 min |
| dry/no pumps | t = 40-60 min |
| sweating, SWR 4 g/h | t = 60-70 min |
| dry/no pumps | t = 70-90 min |
| sweating, SWR 4 g/h | t = 90-100 min |
| dry/no pumps | t = 100 min until "dry" state |

The temperature of the WATson measuring head was held constant at the set temperature by controlled electrical heating. This electrical heating power is stated as "$P_{heating}$" in Watts. As such, the higher the $P_{heating}$ value, the higher the cooling effect (i.e. the cooler the fabric is perceived to be on the skin).

Figure 7:
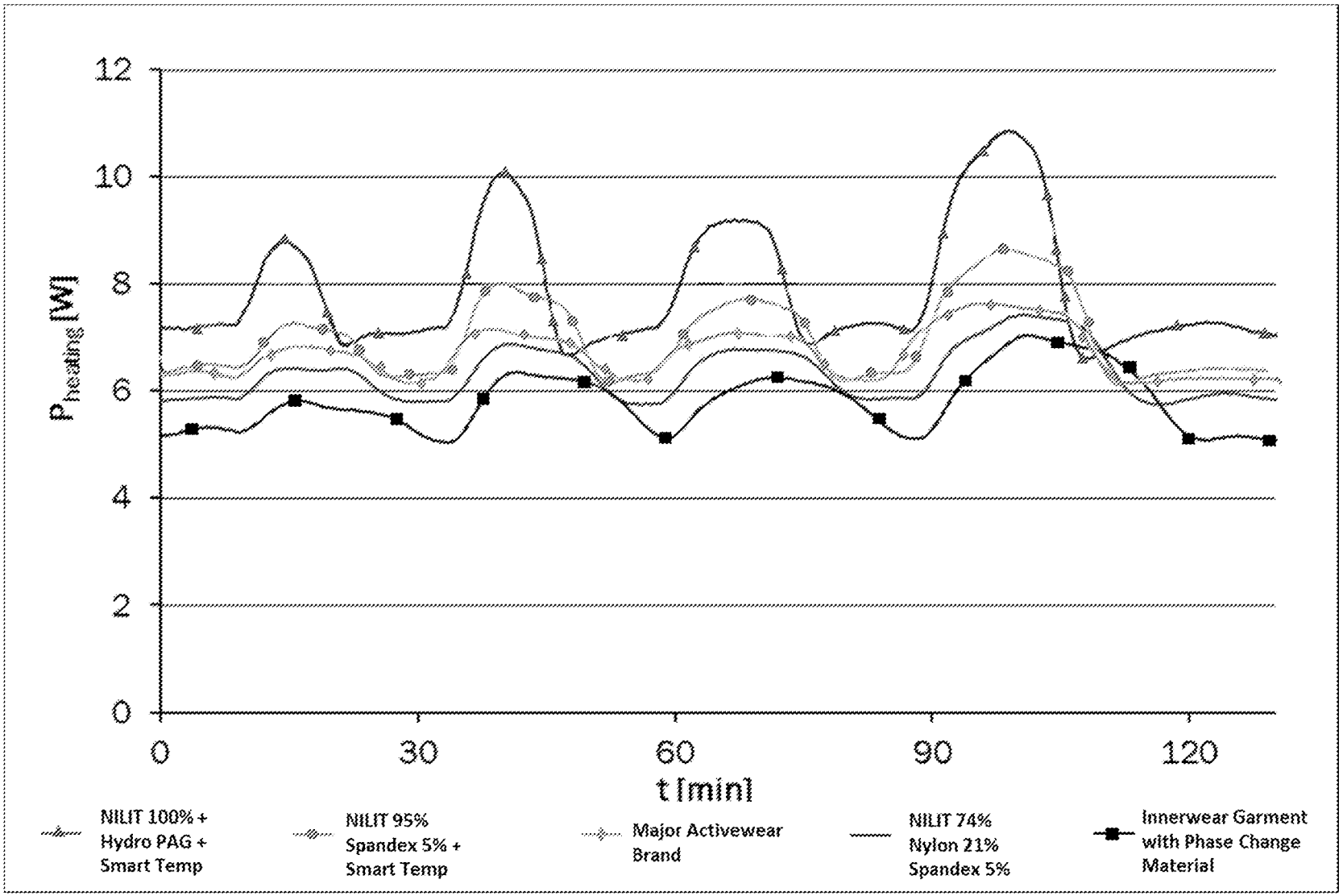
FIG. 7 depicts the cooling power of selected materials/yarns.

All samples were preconditioned in the climatic chamber for 12 hours under the test conditions above. The electrical heating power to maintain the set temperature of the WATson measuring head was recorded. Results for selected materials are provided in FIG. 7 and in Table 3 below.

TABLE 3

| | Cooling Power (in Watts) for the Time Interval | | | | |
|---|---|---|---|---|---|
| Test Specimen | 10 mins | 15 mins | 40 mins | 70 mins | 100 mins |
| NILIT ™ 100% + Hydro PAG ™ + Smart Temp ™ | 7.55 | 8.78 | 10.06 | 9.11 | 10.79 |
| NILIT ™ 95% Spandex ™ 5% + Smart Temp™ | 6.40 | 6.70 | 7.60 | 7.10 | 8.00 |
| Major Activewear Brand | 6.36 | 6.90 | 7.37 | 7.26 | 7.91 |
| NILIT ™ 74% Nylon 21% Spandex ™ 5% | 6.40 | 6.70 | 7.60 | 7.10 | 8.00 |
| Innerwear Garment with Phase Change Material | 5.27 | 5.80 | 6.28 | 6.23 | 7.01 |

Example 2

The tank top was constructed entirely of 100% NILIT™ Breeze Yarn (Nylon), which was then treated with Hydro PAG™ in accordance with the manufacturer's instructions and subsequently treated with Smart Temp™ in accordance with the manufacturer's instructions. The resulting tank top was used in the experiments below.

Example 3

Figure 8:
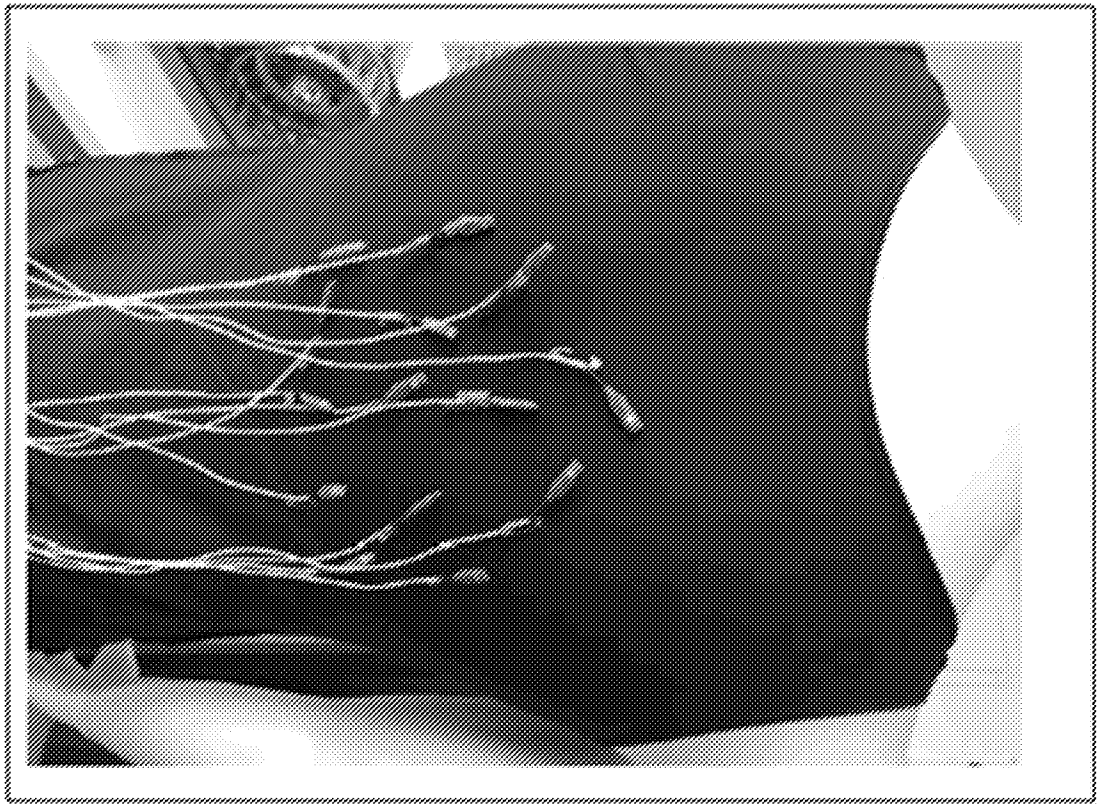
FIG. 8 is a photograph depicts the sensor arrangement used in examples below.

A test tank-top made in accordance with Example 2 was fitted with a THG BodyView microclimate measurement system with 14 sensors mounted across the inner back of the test top is placed on a subject (see FIG. 8). The subject wearing the test top enters a controlled climate chamber with defined environmental conditions in a "cold state" (i.e. without having conducted exercise beforehand) and, after 5 minutes of acclimatisation, the subject will begin to exercise on a bike ergometer at 120 W (strong) to gain heat within the body core. A fifteenth sensor will track the skin temperature at the middle of the subject's back. The THG BodyView tracks temperature, relative humidity and absolute humidity every fifteen seconds. In parallel, the core heat of the subject will be tracked manually by a Withings Thermo from the start of the measurement in sixty second intervals. Once the skin heat indicated a rise of 0.5° C., the exercise will be stopped and the subject allowed to thermoregulate their body temperature down to a "normal" level.

The subject will start to increase perspiration at a certain point of time and will decrease again after the exercise has stopped. The preferred devices of the current invention will show less absolute humidity accumulation between the skin and the tank top over the measurement period, indicating less thermoregulation activity due to better cooling of the subject.

THG BodyView microclimate measurement systems may be obtained from Inside Climate GmbH, Hilpoltsteinerstr 1 b, 83607 Holzkirchen, Germany.

The results obtained are presented in Table 4 below (TT=Tank Top).

TABLE 4

| | TT Run Occupied |
|---|---|
| AH [g/kg] avg | 15.04 |
| T [° C.] avg | 29.93 |
| RH [%] avg | 54.73 |
| Loss Water (g) | n/a |
| Weight TT dry | n/a |
| Weight TT wet | n/a |
| Tskin [° C.] avg | 30.78 |
| Tcore [° C.] avg | 36.26 |
| CC [° C./%RH] | 21/50 |
| Tswtr [° C.] water avg | n/a |
| Heat on [sec] | n/a |
| Heater Level [W] | n/a |
| Swtr Energy Supply [kJ] | n/a |

Example 4

A test tank-top made in accordance with Example 2 fitted with a THG BodyView microclimate measurement system with 14 sensors mounted across the inner back of the test top is placed on a SWEATOR-Torso (see FIG. 8). The SWEATOR-Torso is then pre-heated to provide a $T_{skin}$ of around 35° C. and then the test starts to track data. In a first test phase, the SWEATOR-Torso will maintain the attained temperature using a 50 W power supply for 15 minutes (variable power will be applied to maintain the temperature). Ina second test phase, a stable energy input of 15 W is applied (disregarding the target temperature) for 30 minutes, which will result in a decreasing skin temperature. The sweat rate will react to the changes in temperature on a physical and constant basis. This test will be repeated twice per tank top to be tested. The best tank top (and hence device) will be the top that has the lowest increase in absolute humidity between the tanktop and the SWEATOR-Torso, indicating a more effective environmental control.

THG BodyView microclimate measurement systems and the SWEATOR-Torso may be obtained from Inside Climate GmbH, Hilpoltsteinerstr 1b, 83607 Holzkirchen, Germany.

The results obtained are presented in Table 5 below (TT=Tank Top).

TABLE 5

| | TT Run a | TT Run b | TT Run c | TT Avg |
|---|---|---|---|---|
| AH [g/kg] avg | 15.64 | 16.46 | 16.06 | 16.05 |
| T [° C.] avg | 29.92 | 29.50 | 29.62 | 29.68 |
| RH [%] avg | 60.08 | 58.13 | 60.11 | 59.44 |
| Loss Water (g) | 21.00 | 23.00 | 19.00 | 21.00 |
| Weight TT dry | 182.00 | 180.00 | 181.60 | 181.20 |
| Weight TT wet | n/a | n/a | n/a | n/a |
| Tskin [° C.] avg | n/a | n/a | n/a | n/a |
| Tcore [° C.] avg | n/a | n/a | n/a | n/a |
| CC [° C./%RH] | 21/50 | 21/50 | 21/50 | 21/50 |
| Tswtr [° C.] water avg | 37.01 | 37.01 | 36.99 | 37.00 |
| Heat on [sec] | 932.00 | 956.00 | 975.00 | 954.33 |
| Heater Level [W] | 100.00 | 100.00 | 100.00 | 100.00 |
| Swtr Energy Supply [kJ] | 93.20 | 95.60 | 97.50 | 95.43 |

The invention claimed is:

1. A wearable device for managing and/or reducing hot flash symptoms in a subject, the device comprising:

a first set of components, each comprising a fabric comprising a cooling yarn;

a second set of components, each comprising a quick-dry wicking fabric; and a third set of components, each comprising a phase change material fabric, wherein the first set of components are adapted to cover at least a neckline region and a peripheral region that extends adjacently around an armpit and a clavicle of the subject;

the second set of components are adapted to cover at least an abdominal muscle and a lumbar region of the subject; and the third set of components are adapted to cover at least a mammary and a dorsum region of the subject, wherein the cooling yarn is a yarn that has been shaped to provide a cooling effect on skin.

2. The device according to claim 1, wherein the cooling yarn is a yarn that induces a cooling sensation of from 0.4 to 3.0° C. to a body of a subject wearing the device.

3. The device according to claim 1, wherein the cooling yarn is selected from one or more of a nylon yarn, a polyethylene yarn, a polyester yarn, and combinations thereof.

4. The device according to claim 3, wherein:

(a) each cooling yarn further comprises an inorganic additive material selected from an oxide, silicate, sulfate or mixtures thereof; and/or (b) each cooling yarn is formed from two or more threads that are constructed to remove water/sweat from the skin and then release it slowly from a core of the fabric by evaporation.

5. The device according to claim 1, wherein the cooling yarn forms from 50% to 100% of a yarn content of the cooling yarn fabric.

6. The device according to claim 1, wherein the first, second and third set of components are formed in a single layer of yarn.

7. The device according to claim 1, wherein the quick-dry wicking fabric is a fabric that has inherent wicking properties or is a fabric that has been treated to introduce or enhance wicking properties.

8. The device according to claim 7, wherein:

(a) the quick-dry wicking fabric is a fabric that has been treated to introduce or enhance wicking properties; or (b) the quick-dry wicking fabric is a fabric made from a cooling yearn that has been treated to introduce or enhance wicking properties.

9. The device according to claim 1, wherein the phase change material fabric is a fabric that:

comprises a polymer film laminate layer that incorporates a phase change material; or comprises microcapsules comprising a phase change material.

10. The device according to claim 9, wherein one or both of the following apply:

(a) the phase change material fabric is a fabric that comprises microcapsules comprising a phase change material; and (b) the microcapsules or polymer film further comprises a conduction-enhancing filler material selected from one or more of a metal, a carbon fiber, and a carbon nanotube.

11. The device according to claim 9, wherein one or more of the following apply:

(a) the phase change material is selected from one or more of hydrated inorganic salts, linear crystalline alkyl hydrocarbons, linear long-chain hydrocarbons having formula $C_nH_{2n+2}$, where n is from 13 to 18, polyethylene glycol, fatty esters, fatty acids, long alkyl side chain polymers, the solid state series of pentaerythritol, pentaglycerine, neopentyl glycol, quaternary ammonium clathrates and semi-clathrates, salt hydrides; and (b) the phase change of the phase change material occurs at a temperature of from 29.5 to 39.0° C.

12. The device according to claim 1, wherein the device provides the following minimum heat loss per $m^2$ under the following sweat rate conditions:

| | Heat loss requirement (per $m^2$) | | |
|---|---|---|---|
| Sweat Rate | Area covered by third set of components | Area covered by first and second set of components | Tolerance ($W/m^2$) |
| 0 $g/m^2$ hr | 121 $W/m^2$ | 121 $W/m^2$ | ±20 |
| 72 $g/m^2$ hr | 121 $W/m^2$ | 170 $W/m^2$ | ±30 |
| 100 $g/m^2$ hr | 121 $W/m^2$ | 188 $W/m^2$ | ±30 |
| 200 $g/m^2$ hr | 121 $W/m^2$ | 256 $W/m^2$ | ±40 |
| 300 $g/m^2$ hr | 121 $W/m^2$ | 323 $W/m^2$ | ±40 |
| 400 $g/m^2$ hr | 121 $W/m^2$ | 390 $W/m^2$ | ±50 |
| 500 $g/m^2$ hr | 121 $W/m^2$ | 457 $W/m^2$ | ±50 |

13. The device according to claim 1, wherein the device is in a form of a garment.

14. The device according to claim 1, wherein the device further comprises a fourth set of components adapted to provide a shaping effect on a body of a subject wearing the device, wherein the fourth set of components are one or more of a friction band, rib knit fabric or compression mechanism.

15. The device according to claim 1, wherein the device further comprises, in one or more of the sets of components, one or more of the group selected from anti-odor agents, anti-microbial agents, anti-wrinkling agents and anti-pilling agents.

16. The device according to claim 1, wherein:

(a) a fabric comprising a cooling yarn which has inherent wicking properties or has been treated to introduce or enhance wicking properties forms the first and second sets of components and is adapted to cover at least the regions covered by the first and second sets of components as defined in claim 1;

(b) a fabric comprising a cooling yarn and a phase change material forms the first and third sets of components and is adapted to cover at least the regions covered by the first and third sets of components as defined in claim 1; or (c) a fabric comprising a quick-dry wicking fabric and a phase change material forms the second and third sets of components and is adapted to cover at least the regions covered by the second and third sets of components as defined in claim 1.

17. The device according to claim 1, wherein a fabric comprising a cooling yarn, a phase change material and which has inherent wicking properties or has been treated to introduce or enhance wicking properties forms the first to third sets of components, such that the combined fabric is adapted to cover at least all regions as defined in claim 1.

18. The device according to claim 17, wherein the fabric forming the first to third sets of components is formed using a nylon containing an inorganic additive, coated with a phase change material or microparticles containing a phase change material.

19. A method of reducing and/or managing hot flash symptoms in a subject, wherein the method comprises wearing a device according to claim 1.

* * * * *